US008794556B2

(12) United States Patent
Schwelling

(10) Patent No.: US 8,794,556 B2
(45) Date of Patent: Aug. 5, 2014

(54) COLLECTION CONTAINER FOR A FILE SHREDDER

(76) Inventor: Hermann Schwelling, Salem (DE)

( * ) Notice: Subject to any disclaimer, the term of this patent is extended or adjusted under 35 U.S.C. 154(b) by 456 days.

(21) Appl. No.: 12/449,229

(22) PCT Filed: Jan. 29, 2008

(86) PCT No.: PCT/EP2008/000649

§ 371 (c)(1),
(2), (4) Date: Jul. 29, 2009

(87) PCT Pub. No.: WO2008/092622

PCT Pub. Date: Aug. 7, 2008

(65) Prior Publication Data

US 2010/0001109 A1 Jan. 7, 2010

(30) Foreign Application Priority Data

Jan. 30, 2007 (DE) ..... 10 2007 006 315

(51) Int. Cl.
*B02B 7/02* (2006.01)
*B02C 23/00* (2006.01)

(52) U.S. Cl.
USPC ..... 241/100; 241/169; 241/285.2

(58) Field of Classification Search
USPC ..... 241/100, 236, 285.2, 169; 220/908; 206/216
See application file for complete search history.

(56) References Cited

U.S. PATENT DOCUMENTS

| | | | | |
|---|---|---|---|---|
| 3,282,635 | A * | 11/1966 | Himelreich | 312/330.1 |
| 5,897,065 | A * | 4/1999 | Schwelling | 241/100 |
| 6,079,645 | A * | 6/2000 | Henreckson et al. | 241/37.5 |
| 6,193,091 | B1 | 2/2001 | Olivetti | |
| 6,962,301 | B1 | 11/2005 | Chang | |
| 7,469,849 | B1 * | 12/2008 | Lo | 241/100 |
| 7,513,448 | B2 * | 4/2009 | Ko | 241/100 |
| 7,537,176 | B2 * | 5/2009 | Shen | 241/37.5 |
| 2007/0018020 | A1 * | 1/2007 | Wang | 241/100 |
| 2007/0034723 | A1 * | 2/2007 | Joachim et al. | 241/100 |

FOREIGN PATENT DOCUMENTS

| | | |
|---|---|---|
| DE | 24 19 369 | 11/1975 |
| DE | 203 01 793 | 6/2004 |
| DE | 20 2006 014 906 | 12/2006 |

* cited by examiner

*Primary Examiner* — David Walczak
*Assistant Examiner* — Jennifer C Chiang
(74) *Attorney, Agent, or Firm* — Collard & Roe, P.C.

(57) ABSTRACT

The invention relates to a collection container for a paper shredder, the container being removably arranged in an interior that is open to one side and located below a cutting mechanism in the housing of the paper shredder or a similar device. The invention is characterized in that a front wall of the collection container is associated with a profiled front part and is connected to the same in at least some sections.

16 Claims, 3 Drawing Sheets

D (2 : 1)

F (2 : 1)

B (2 : 1)

G (2 : 1)

COLLECTION CONTAINER FOR A FILE SHREDDER

CROSS REFERENCE TO RELATED APPLICATIONS

Figure 1:
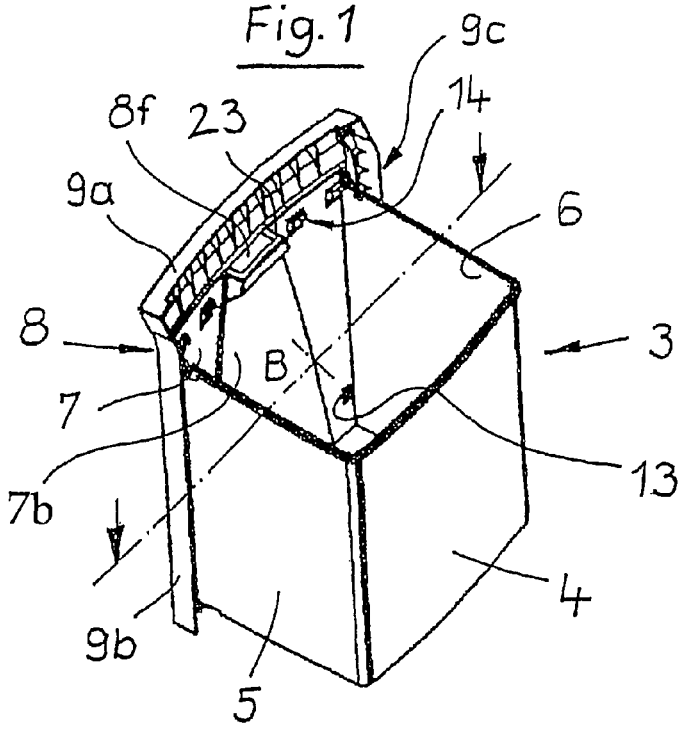

This application is the National Stage of PCT/EP2008/000649 filed on Jan. 29, 2008, which claims priority under 35 U.S.C. §119 of German Application No. 10 2007 006 315.8 filed on Jan. 30, 2007. The international application under PCT article 21(2) was not published in English.

The invention relates to a collection container for a file shredder, which container is removably disposed in an interior of a housing and below a cutting mechanism of the file shredder.

File shredders for shredding data carrier material in the form of documents in sheet form, CDs, microfilms, diskettes, and similar materials, are known in the most varied embodiments and performance classes.

According to one type, the collection receptacles are configured as a collection container, often also called a paper basket or collection basket. The front surface of such collection containers, in other words the surface that points toward the user, is simultaneously integrated into the front surface of the file shredder in the case of many types, in other words the two narrow face surfaces of the side walls of the housing of the file shredder and the front surface of the collection container form the front surface of the file shredder.

For quite some time, the said collection containers have been made from plastic. In order to keep both production costs and transport costs low, these collection containers are subject to constant optimization, particularly also with regard to reducing the thickness of the body walls. However, this has the result, particularly in the upper open region of the collection container, that it becomes unstable. If handled carelessly when it is removed from the housing, for the purpose of emptying out the collected material, and when it is set back into the housing, damage to the collection container itself and to the narrow face surfaces of the side walls of the file shredder housing cannot always be avoided.

Also, under various circumstances, it can occur that the user puts weight on the front surface of the collection container, and in the case of the collection containers that are known up to now, this can lead to breaking of its walls. As a result of such breakage, sharp edges occur, which can cause the user to incur injuries due to cutting or tearing.

For this reason, the task of the invention consists in developing a collection container for file shredders that has increased stability but is also cost-advantageous with regard to the material and production costs, as well as the transport costs.

In the sense of the present invention, a file shredder is understood to be a device for shredding data carrier material, which can be documents in sheet form, CDs, microfilms, diskettes and similar material.

The task is accomplished by means of a collection container for a file shredder according to the invention. Further developments and advantageous embodiments of the invention are discussed below.

According to the invention, the collection container removably disposed in an interior of the housing of the file shredder or similar device, which interior is open on one side and provided below a cutting mechanism, has a specially profiled front part assigned to it, on its front wall, which part is connected with the wall at least in certain sections. According to a further development, at least a left and a right edge region, preferably also a top edge region of the front part project laterally beyond the front wall.

The front part lies directly against the outside of the front wall with its inside, or, according to a further embodiment, the front part is disposed on the front wall with its inside at a distance from the outside, at least in certain sections.

It is furthermore advantageous if at least two strips are disposed spaced apart from one another on the inside of the front part, between which strips the front longitudinal edges of the front wall of the collection container as well as regions of the side walls close to the edge are positioned, preferably also held with a shape fit.

Furthermore, catch parts are provided in the upper region, on the inside of the front part, to hook into the front wall, as are support parts in the lower region, which engage into a perforation in the front wall, in each instance.

Specifically, the catch parts, particularly the ones provided in the upper region, engage into the front wall of the collection container in such a manner that during handling of the collection container, particularly during removal of the filled collection container, the direction of effect of the engaging force does not counteract inter-hooking, in other words in case of disadvantageous handling, the inter-hooking could come loose, as could be the case with some other embodiments of collection containers in the state of the art, for example in the case of a collection container according to DE 203 01 793 U1.

The parts of the front part that project beyond the top and sides of the collection container preferably have multiple rib-shaped crosspieces, thereby achieving additional stability in the front region.

Furthermore, a recess that preferably narrows conically extends in the front part of the collection container, symmetrical to its median plane, upward on the body, which recess projects from the lower edge all the way into the upper region and ends at a base that lies crosswise on the top.

Corresponding to the location and shape of this recess in the front part, an indentation is formed in the front wall, inward relative to the body, having a flat part and angled narrow sides.

Furthermore, it is provided that the longitudinal edges of the indentation, which are directed upward, are profiled, preferably configured in U shape, and that the shanks of the recess of the front part, which run correspondingly, each possess a nose strip, which strips are accommodated in the U profile, with shape fit, in the assembled state.

By means of at least one of the new characteristics for the configuration of a collection container as mentioned above, increased stability of the container is achieved. Further advantages result from the configuration characteristics mentioned below.

For example, according to a further development, the base of the recess in the front part, which base lies crosswise at the top, is extended inward relative to the body and, at the same time, configured as a handle depression. In connection with an adapted shaping of the upper region of the indentation in the front wall, good ergonomic configuration of the handle depression is achieved, and, at the same time, reaching into the interior of the collection container is prevented.

Furthermore, it is advantageous that the edges of the side walls of the collection container are inclined downward, starting from the front wall, toward the rear, toward the rear wall, so that introduction of the collection container into the interior is further facilitated.

Furthermore, it is provided that at least some surface sections of the collection container consist of translucent, preferably transparent material; preferably its front wall, particularly the surface part of the indentation provided in the wall.

Other advantages can be achieved in that the front part is connected with the front wall with force fit and/or shape fit; by means of being screwed, glued and/or welded together. This connection between the two parts can be provided at points, in certain sections, or throughout.

Figure 2:
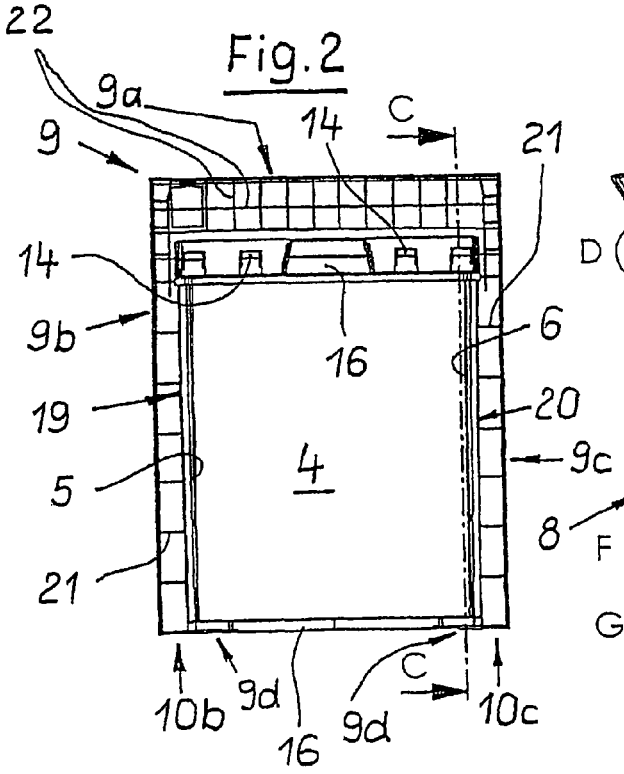
Figure 3:
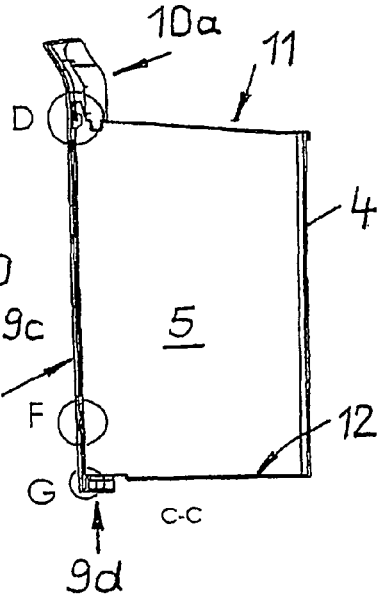
Figure 3A:
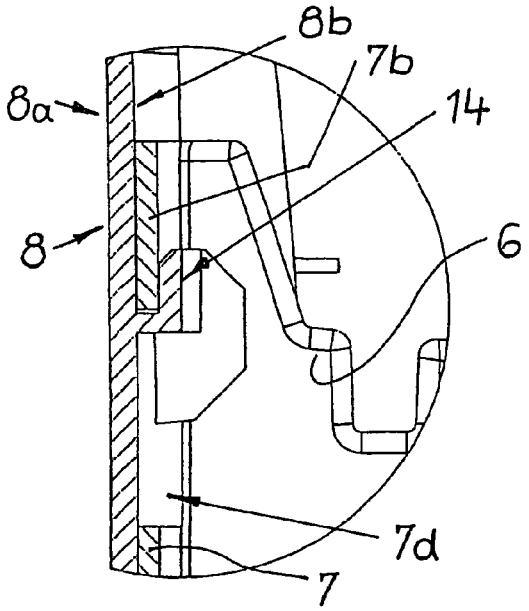
Figure 3B:
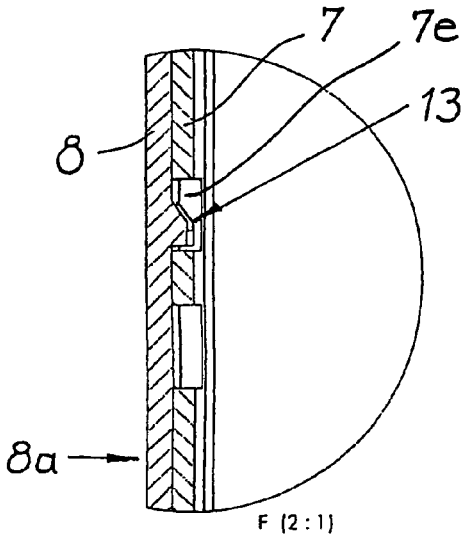
Figure 3D:
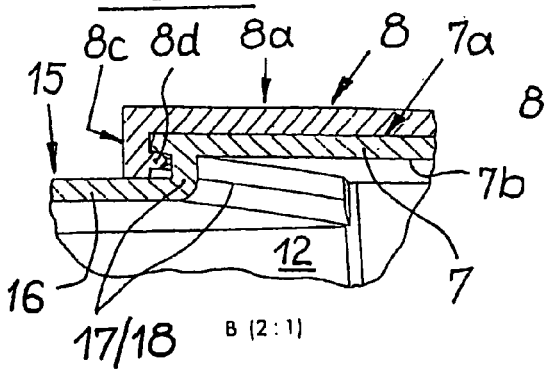
Figure 3C:
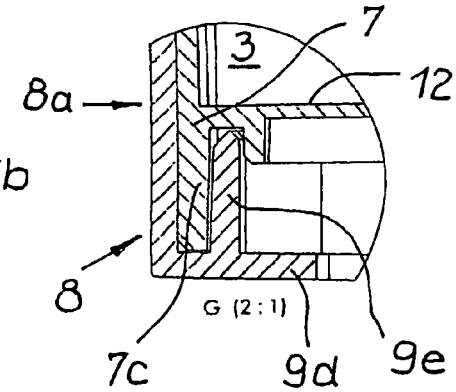
Figure 4:
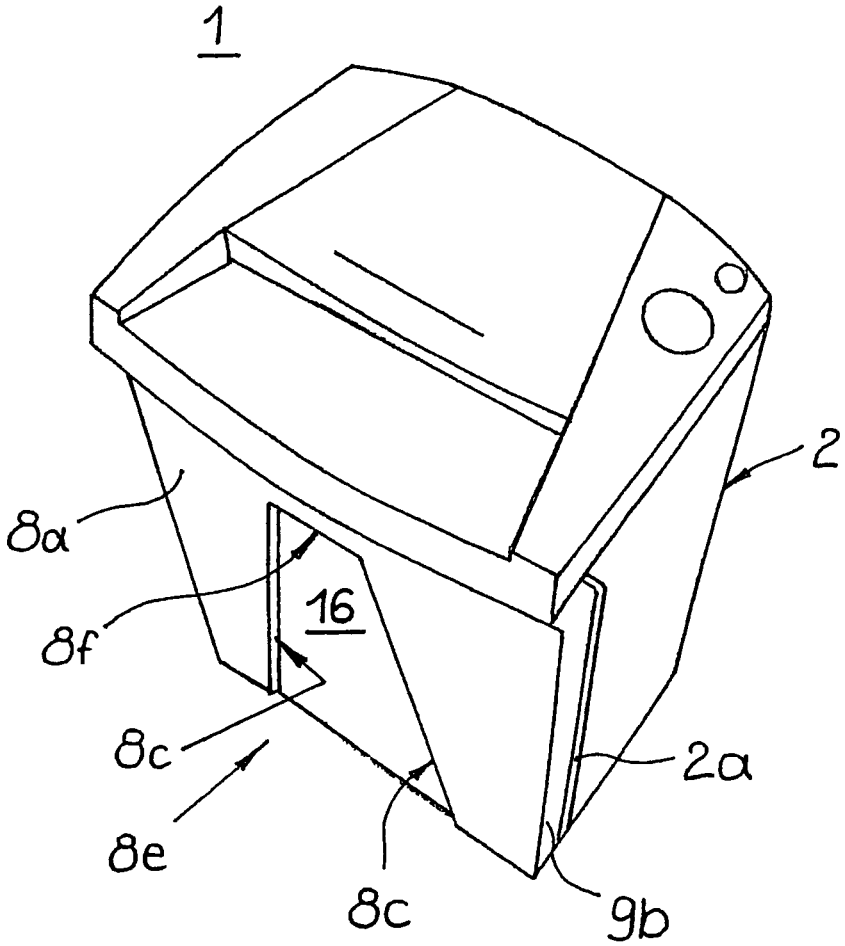

The invention will be explained in detail and further in the following, using an exemplary embodiment. In this connection, the drawing shows:

FIG. 1 a perspective view of the new collection container;

FIG. 2 a vertical section along line B of FIG. 1 showing a view from the rear of the collection container and the inside of its front part;

FIG. 3 a section C-C of FIG. 2 showing a side view of the collection container according to FIG. 1;

FIG. 3*a* an enlarged view of FIG. 3 at area D which shows details of the connection between the front part and the collection container;

FIG. 3*b* an enlarged view of FIG. 3 at area F;

FIG. 3*c* an enlarged view of FIG. 3 at area G;

FIG. 3*d* an enlarged view showing details of the connection between the front part and the collection container in a view from above of a cross-section taken in the plane of the rectangular bottom of the collection container; and FIG. 4 a file shredder having the new collection container.

The collection container according to the invention is shown in different views in FIGS. 1, 2, and 3, and in detail in FIGS. 3*a*, 3*b*, 3*c*, and 3*d*. It consists of an essentially rectangular bottom 12 and walls that proceed from it, directed upward, the rear wall 4, the right side wall 5, the left side wall 6, and the front wall 7, and is preferably configured in one piece. The collection container is made from plastic. At least its front wall 7 is made of a translucent, preferably a transparent material.

According to the invention, the front wall 7 has a front part 8 assigned to it, in front of it. The front part 8, a profiled molded part, lies against the outside 7*a* of the front wall 7 with its inside 8*b* preferably in certain sections. The front part 8 is connected with the front wall 7 by means of catch parts 14 and support parts 13. The catch parts 14 pass through the front wall 7, preferably in the upper surface section. The support parts 13 pass through the front wall 7, preferably in the lower surface section.

In FIG. 2, it can be seen that the expanse of the front part 8, in terms of area, is greater than the area taken up by the front wall 7.

In this way, the result is achieved that with regard to the body of the collection container, an upper projection 10*a*, a right projection 10*b*, and a left projection 10*c* are formed.

On the inside 8*b* of the front part 8, two strips that project away from the inner surface and are at a distance from one another are disposed. Between these strips, at least the two longitudinally oriented body edges of the front wall 7 of the collection container are positioned and held with shape fit. Preferably, the regions of the side walls 5 and 6 close to the edges are also covered by these strips, with shape fit. In the region of the projections 10*a*, 10*b*, and 10*c*, multiple rib-like crosspieces 21 arranged crosswise are disposed on the inside 8*b* of the front part 8, between the strips 19 and 20, and the outer edge 9 of the right 9*b* and the left section 9*c*. Rib-like crosspieces 22 are disposed on the inside of the upper projection 10*a*, in the manner of a lattice.

In FIG. 3*a*, the engagement of the front part 8 with the front wall 7 by means of a catch strip 14 is shown once again, in detail. The front wall 7 possesses a perforation 7*d* there for each catch part 14. Each catch part 14 passes through a perforation 7*d* and lies firmly against the inside 7*b* of the front wall 7 with its hook part. In this representation, the catch part 14 that lies close to the side wall 6 is shown.

According to FIG. 3*b*, the cam-like support part 13 provided in the lower region of the front part 8, on its inside 8*b*, engages into a corresponding perforation 7*e* provided in the front wall 7. FIG. 3*c* shows how the front part 8 lies against the front wall 7 and is attached to it, in the lower edge region. The front wall 7 projects beyond the bottom 12 of the collection container 3, forming a tab-like crosspiece 7*c*. The lower section 9*d* of the outer edge 9 of the front part 8 is not continuous, because the recess 8*e* is disposed in the center. The two lower edge sections 9*d* that are formed as a result, which extend essentially at a right angle from the basic body surface of the front part 8, just like the upper section 9*a*, the right section 9*b*, and the left sections 9*c*, each possess a crosspiece 9*e* directed upward, which, together with the related section of the front part 8, forms a U-shaped groove, into which the tab-like crosspiece 7*c* of the front wall 7 is inserted. The two lower edge sections 9*d* therefore project beyond the bottom 12 of the collection container 3 and thus are contact surfaces for contact of the frontal front of the collection container and the related face sides of the housing 2, together with the upper projection 10*a*, the right projection 10*b*, and the left projection 10*c*. They are, at the same time, stops with regard to the planned positioning of the collection container 3 below the cutting mechanism of the file shredder 1 disposed in the housing 2, which shredder is shown in perspective in FIG. 4. The other reference symbols contained in FIG. 4 correspond to what has already been mentioned in the above part of the description. The inserted collection container 3 closes the opening 2*a* of the accommodation space in the housing 2.

In FIG. 3*d*, the detail concerning the indentation 15 provided in the front wall 7, inward relative to the body, is shown. This indentation 15 possesses a surface part 16 as well as narrow sides 18 on both sides, having longitudinal edges 17 that are configured in U shape and profiled. A nose strip 8*d* of the angled-away shanks 8*c* of the front part 8 engages into these U-shaped longitudinal edges 17, in each instance. The shanks 8*c* are also a part of the recess 8*e* provided in the front part 8 of the collection container 3, symmetrical to its median plane, upward relative to the body. This recess 8*e* is configured to narrow conically upward, and reaches from the lower edge all the way to the upper region, and ends there at a base 8f that lies crosswise at the top. The recess 8*e* furthermore intersects the outside 8*a* and the inside 8*b* of the front part 8.

The inside 8*b* of the front part 8 lies against the outside 7*a* of the front wall 7 here.

At least the surface part 16 of the indentation 15 consists, in the case of the embodiment shown, of a translucent, preferably transparent material, and thus always allows a view into the collection container for the purpose of observing its level of filling or the quality of shredding of the material that has been input.

FIG. 3 furthermore shows that in the case of this embodiment, the upper edges 11 of the side walls 5 and 6 are inclined in the direction of the rear wall 4, proceeding from the front wall 7.

The base 8*f* of the recess 8*e* that lies crosswise at the top, see FIG. 1, is extended inward with regard to the body, thereby forming a handle depression 23. The upper region of the indentation 15 is furthermore shaped to be adapted to this extension, so that the handle depression is closed toward the interior of the collection container 3.

REFERENCE SYMBOL LIST

1 file shredder
2 housing

2*a* opening (of the accommodation space in item 2)
3 collection container
4 rear wall
5 right side wall
6 left side wall
7 front wall
7*a* outside
7*b* inside
7*c* tab-like crosspiece
7*d* perforation (in item 7)
7*e* perforation (in item 7)
8 front part
8*a* outside
8*b* inside
8*c* shank
8*d* nose strip
8*e* recess
8*f* base (of item 8*e*)
9 outer edge
9*a* upper section
9*b* right section
9*c* left section
9*d* lower section
9*e* crosspiece
10*a* upper projection
10*b* right projection
10*c* left projection
11 inclined edges (on items 5 and 6)
12 bottom
13 support parts (cams)
14 catch parts
15 indentation
16 surface part
17 longitudinal edges
18 narrow sides
19 strip
20 strip
21 rib-like crosspieces
22 rib-like crosspieces
23 handle depression

The invention claimed is:

1. A file shredder comprising:
a housing having an interior;
a cutting mechanism;
a collection container removably disposed in the interior of the housing and below the cutting mechanism, the collection container having a front wall; and
a profiled front part in addition to the collection container and connected with the front wall;
wherein the profiled front part has a first strip and a second strip disposed spaced apart from one another on an inside of the profiled front part;
wherein the collection container has a first side wall, a second side wall, and front longitudinal edges, the first side wall having a first front region close to the front longitudinal edges, and the second side wall having a second front region close to the front longitudinal edges; and
wherein the front longitudinal edges as well as the first front region and the second front region are positioned between the first strip and the second strip of the profiled front part.

2. The file shredder according to claim 1, wherein at least a left edge region and a right edge region of the profiled front part project laterally beyond the front wall.

3. The file shredder according to Claim 1, wherein the profiled front part has an inside and lies directly with the inside against an outside of the front wall.

4. The file shredder according to claim 1, wherein the profiled front part has an inside portion disposed at least partly on an outside portion of the front wall.

5. The file shredder according to claim 1, wherein catch parts are provided in an upper region of the profiled front part on an inside of the profiled front part to hook into the front wall.

6. The file shredder according to claim 1, wherein support parts are provided in a lower region of the profiled front part on an inside of the profiled front part.

7. The file shredder according to claim 1, wherein a recess extends in the profiled front part and narrows conically, the recess extending symmetrical to a vertical median plane of the recess and extending upward on a body of the profiled front part, the recess projecting from a lower edge of the profiled front part into an upper region of the profiled front part, all the way to a base of the profiled front part, the base lying crosswise at a top of the profiled front part.

8. The file shredder according to claim 7, wherein a handle depression is formed on the base of the profiled front part.

9. The file shredder according to claim 1, wherein top edges of side walls of the collection container are inclined downward, starting from the front wall toward a rear wall of the collection container.

10. The file shredder according to claim 1, wherein the profiled front part is connected with the front wall with a first shape of the profiled front part fitting a second shape of the front wall and/or with a force fit.

11. The file shredder according to claim 10, wherein the profiled front part is connected with the front wall via screwing, gluing and /or welding.

12. The file shredder according to claim 1, wherein at least surface sections of the collection container comprise translucent material.

13. A file shredder comprising:
a housing having an interior;
a cutting mechanism;
a collection container removably disposed in the interior of the housing and below the cutting mechanism, the collection container having a front wall; and
a profiled front part in addition to the collection container and connected with the front wall;
wherein the profiled front part has projections projecting beyond the collection container at a top of the collection container and at sides of the collection container and have multiple crosspieces, in each instance, each crosspiece forming a rib.

14. A file shredder comprising:
a housing having an interior;
a cutting mechanism;
a collection container removably disposed in the interior of the housing and below the cutting mechanism, the collection container having a front wall; and
a profiled front part in addition to the collection container and connected with the front wall;
wherein a recess extends in the profiled front part and narrows conically, the recess extending symmetrical to a vertical median plane of the recess and extending upward on a body of the profiled front part, the recess projecting from a lower edge of the profiled front part into an upper region of the profiled front part, all the way to a base of the profiled front part, the base lying crosswise at a top of the profiled front part; and wherein corresponding to the position and shaping of the recess in the profiled front part, an indentation is configured in the front wall, the indentation having a surface part and angled-away narrow sides.

15. The file shredder according to claim 14, wherein longitudinal edges of the angled-away narrow sides are profiled, wherein the longitudinal edges are directed upwards, and wherein shanks of the recess run correspondingly to each other and each possesses a nose strip accommodated in the longitudinal edges of the angled-away narrow sides in an assembled state of the file shredder.

16. A file shredder comprising:

a housing having an interior;

a cutting mechanism;

a collection container removably disposed in the interior of the housing and below the cutting mechanism, the collection container having a front wall; and a profiled front part in addition to the collection container and connected with the front wall;

wherein the profiled front part is connected with the front wall with a first shape of the profiled front part fitting a second shape of the front wall and/or with a force fit; and wherein the profiled front part is connected with the front wall with a force-fit, the force-fit being in point form.

* * * * *